US012006651B2

(12) United States Patent
Jung et al.

(10) Patent No.: US 12,006,651 B2
(45) Date of Patent: Jun. 11, 2024

(54) PILE DRIVING SYSTEM

(71) Applicant: IQIP HOLDING B.V., Sliedrecht (NL)

(72) Inventors: Boudewijn Casper Jung, Bergen op Zoom (NL); Henricus Gerardus Andreas Van Vessem, Vught (NL); Willibrordus Adelbertus Maria Brouwer, Zaltbommel (NL)

(73) Assignee: IQIP HOLDING B.V., Sliedrecht (NL)

( * ) Notice: Subject to any disclaimer, the term of this patent is extended or adjusted under 35 U.S.C. 154(b) by 398 days.

(21) Appl. No.: 17/295,366

(22) PCT Filed: Nov. 20, 2019

(86) PCT No.: PCT/NL2019/050762

§ 371 (c)(1),
(2) Date: May 19, 2021

(87) PCT Pub. No.: WO2020/106147

PCT Pub. Date: May 28, 2020

(65) Prior Publication Data

US 2022/0018081 A1 Jan. 20, 2022

(30) Foreign Application Priority Data

Nov. 22, 2018 (NL) ..... 2022051

(51) Int. Cl.

| | |
|---|---|
| ***E02D 7/10*** | (2006.01) |
| *E02D 7/16* | (2006.01) |
| *E02D 13/00* | (2006.01) |

(52) U.S. Cl.

CPC ..... *E02D 7/10* (2013.01); *E02D 7/16* (2013.01); *E02D 13/00* (2013.01)

(58) Field of Classification Search

CPC .... E02D 7/14; E02D 7/10; E02D 7/08; E02D 7/16; E02D 13/00; F16D 63/008; F16F 7/08; F16F 7/09; F16F 7/095

See application file for complete search history.

(56) References Cited

U.S. PATENT DOCUMENTS

| | | | |
|---|---|---|---|
| 3,600,031 | A | 8/1971 | Coleman et al. |
| 3,666,216 | A | 5/1972 | Nagy et al. |

(Continued)

FOREIGN PATENT DOCUMENTS

| | | | |
|---|---|---|---|
| CN | 104234031 | B | 12/2015 |
| CN | 204982889 | U | 1/2016 |

(Continued)

OTHER PUBLICATIONS

Chinese Office Action in corresponding Chinese Patent Application No. 201980076329.7 dated Aug. 17, 2022.

(Continued)

*Primary Examiner* — Thomas M Wittenschlaeger
(74) *Attorney, Agent, or Firm* — Steven M. Koehler; Westman, Champlin & Koehler, P.A.

(57) ABSTRACT

A pile driving system comprises a lifting element attached or attachable to a hoisting cable of a crane, a pile driver which is mounted to the lifting element and movable with respect to the lifting element in a pile driving direction and a brake for braking a movement of the pile driver with respect to the lifting element. The brake comprises cooperating sliding members at the lifting element and the pile driver, which sliding members are pressed against each other in a direction extending transversely to their mutual sliding direction.

25 Claims, 7 Drawing Sheets

(56) References Cited

U.S. PATENT DOCUMENTS

| | | | |
|---|---|---|---|
| 4,360,230 | A | 11/1982 | Wood et al. |
| 4,518,186 | A | 5/1985 | Hornberg |
| 6,223,675 | B1 | 5/2001 | Watt et al. |
| 6,257,162 | B1 | 7/2001 | Watt et al. |
| 6,390,012 | B1 | 5/2002 | Watt et al. |
| 6,447,036 | B1 | 9/2002 | White |
| 7,648,183 | B2 | 1/2010 | Cornwell |
| 9,067,766 | B1 | 6/2015 | Bateman et al. |
| 2017/0016199 | A1 | 1/2017 | Elmer |
| 2018/0282967 | A1 | 10/2018 | Elliott |
| 2019/0390432 | A1 | 12/2019 | Van Vessem et al. |

FOREIGN PATENT DOCUMENTS

| | | | | | |
|---|---|---|---|---|---|
| CN | 103422505 | B | | 5/2016 | |
| CN | 108396742 | A | * | 8/2018 | ..... E02D 7/06 |
| CN | 108396742 | A | | 8/2018 | |
| DE | 1634661 | A1 | | 7/1970 | |
| EP | 1640508 | B1 | | 1/2008 | |
| EP | 2500473 | B1 | | 8/2013 | |
| EP | 2752361 | B1 | | 4/2016 | |
| EP | 3034860 | B1 | | 6/2016 | |
| GB | 2417233 | A | | 2/2006 | |
| JP | S50-032001 | Y | | 9/1975 | |
| JP | S52-056462 | A | | 5/1977 | |
| JP | 10-279289 | A | | 10/1998 | |
| WO | 2008106964 | A1 | | 9/2008 | |
| WO | 2010089096 | A1 | | 8/2010 | |
| WO | 2018139931 | A1 | | 8/2018 | |

OTHER PUBLICATIONS

International Search Report and Written Opinion for corresponding International Application No. PCT/NL2019/050762 dated Jan. 31, 2020.

Office Action in corresponding Japanese Patent Application No. 2021-527204 dated Sep. 11, 2023.

* cited by examiner

PILE DRIVING SYSTEM

CROSS-REFERENCE TO RELATED APPLICATIONS

This application is a Section 371 National Stage Application of International Application No. PCT/NL2019/050762, filed Nov. 20, 2019 and published as WO 2020/106147 A1 on May 28, 2020, in English.

BACKGROUND

The present invention relates to a pile driving system, comprising a lifting element attached or attachable to a hoisting cable of a crane, a pile driver which is mounted to the lifting element and movable with respect to the lifting element in a pile driving direction and a brake for braking a movement of the pile driver with respect to the lifting element.

Such a pile driving system is known from WO 2018/139931 and is suitable to reduce a shock load on the crane after the pile driver is freefalling. This typically occurs during installing a pile in the event that the tip of the pile reaches a ground layer providing low resistance. The pile may start running into the ground due to its own weight and the weight of the pile driver resting on the pile. The pile driver must be arrested by the crane resulting in a huge shock load. The known pile driving system brakes the movement of the pile driver with respect to the lifting element by means of a complex hydraulic damping and compression circuit.

SUMMARY

An aspect of invention is a pile driving system having a brake comprising cooperating sliding members at the lifting element and the pile driver, which sliding members are pressed against each other in a direction extending transversely to their mutual sliding direction.

Pressing the sliding members to each other provides the opportunity to create a relatively high static friction between the sliding members such that the pile driver remains at a fixed position with respect to the lifting element up to a certain force level of the pile driver onto the lifting element in their mutual sliding direction. When the hoisting cable arrests the pile driver in the event that it is in a freefalling condition, the hoisting cable exerts a force onto the pile driver via the lifting element and the sliding members, hence causing a deceleration of the pile driver. When this force overcomes the static friction between the sliding members, the pile driver will move with respect to the lifting member whereas dynamic friction occurs when the cooperating sliding members rub together. Consequently, the movement of the pile driver with respect to the lifting element is gradually decelerated by conversion of kinetic energy into thermal energy, hence avoiding a shock load in a relatively simple way. Conversion into thermal energy may further lead to thermal expansion of the sliding members, hence increasing friction progressively.

The mutual sliding direction of the sliding members refers to the direction of the path along which the sliding members slide along each other. In practice the mutual sliding direction of the sliding members and the pile driving direction may be the same. It is noted that the pile driving direction refers to the direction in which a pile is driven by the pile driver under operating conditions and the opposite direction.

In a particular embodiment the sliding members are configured such and the force between the sliding members is selected such that the brake keeps the pile driver at a fixed position with respect to the lifting element by static friction between the sliding members up to a predetermined force level of the pile driver on the lifting element in their mutual sliding direction.

The predetermined force level may be at least 1.1, and preferably at least 1.4, times the weight of the pile driver. This means that the static friction will be overcome after the lifting element and the pile driver are already decelerating due to increased tension in the hoisting cable.

At least one of the sliding members may be pressed against the other by a hydraulic cylinder.

Alternatively, at least one of the sliding members may be pressed against the other by a spring.

In still another embodiment at least one of the sliding members is made of a resilient material, for example rubber.

In a particular embodiment one of the pile driver and the lifting element is provided with a rod extending in the pile driving direction and guided by the other one of the pile driver and the lifting element, wherein the rod forms the sliding member at the one of the pile driver and the lifting element which sliding member cooperates with the sliding member at the other one of the pile driver and the lifting element.

The sliding member at the other one of the pile driver and the lifting element may comprise a pair of friction blocks which engage the rod at opposite sides thereof.

The rod may be tapered such that the distance between the friction blocks increases during a movement of the pile driver away from the lifting element. This creates a progressive braking behavior. In case the friction blocks are pressed against the rod the spring force will increase during the movement. In case of a hydraulic force the hydraulic pressure will be increased during the movement; in this case the hydraulic, system may be provided with an accumulator.

In an alternative embodiment the lifting element comprises a cylindrical outer surface which is at least partly accommodated within a cylindrical inner surface of the pile driver, wherein one of the inner surface and the outer surface is provided with at least a protruding rib extending in the pile driving direction and the other one of the inner surface and the outer surface is provided with a pair of friction blocks which exert a clamping force on the rib.

BRIEF DESCRIPTION OF THE DRAWINGS

Aspects of the invention will hereafter be elucidated with reference to very schematic drawings showing embodiments of the invention by way of example.

DETAILED DESCRIPTION

Figure 1:
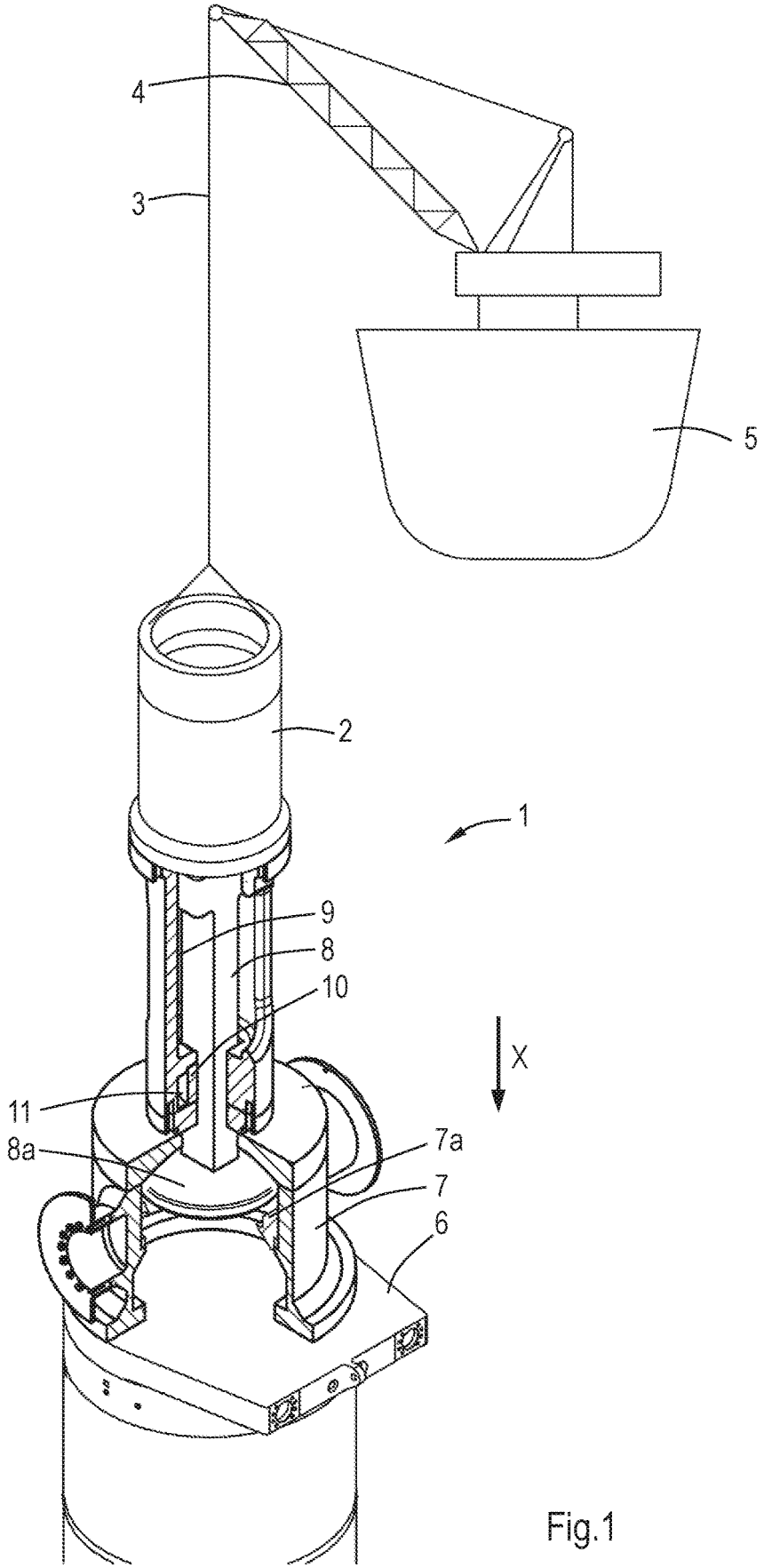
FIG. 1 is a perspective view of an embodiment of a pile driving system.

FIG. 1 shows an embodiment of a pile driving system 1. The pile driving system 1 has a lifting element 2 which is attached to a hoisting cable 3 of a crane 4 on a barge 5. The crane 4 is provided with a winch (not shown) for paying out and taking in the hoisting cable 3. The pile driving system 1 is suitable for installing a monopile (not shown) an underwater ground formation, e.g. a seabed, but applying the system 1 ashore is also conceivable.

The pile driving system 1 further comprises a hydraulic pile driver 6 and a transition cylinder 7 which are fixed to each other. A rod 8 is mounted to the pile driver 6 and the transition cylinder 7. A bottom end of the rod is provided with a plate 8*a* which is movable within the transition cylinder 7. During normal pile driving the plate 8*a* can rest on a collar 7*a* inside the transition cylinder 7 between two successive blows of the pile driver 6. When the pile driver 6 and a monopile together move downwardly during a blow the transition cylinder 7 also moves downwardly. Under normal pile driving conditions the rod 8 has a fixed position with respect to the lifting element 2, which means that during a blow of the pile driver 6 the transition cylinder 7 can move downwardly with respect to the lifting element 2 including the rod 8, whereas the lifting element 2 including the rod 8 may follow the movement somewhat later. It is noted that under normal pile driving conditions there is minimal or no tension load in the hoisting cable 3, hence avoiding repetitive load pulses onto the crane 4.

Under certain conditions the rod 8 is also movable with respect to the lifting element 2 in a vertical pile driving direction X within a cylinder 9 which is located inside the lifting element 2, which will be explained hereinafter. In the embodiment as shown in FIG. 1 the rod 8 has a rectangular cross section, but a different shape, for example circular, is also conceivable.

The pile driving system 1 is provided with a brake in the form of a friction block 10 which is pressed against the rod 8 by means of a hydraulic pressure chamber 11. This means that the rod 8 forms a first sliding member whereas the friction block 11 forms a second sliding member of two cooperating sliding members, the first sliding member being located at the pile driver 6 and the second sliding member being located at the lifting element 2. The sliding members can move relative to each other in their mutual sliding direction, which is the same direction as the pile driving direction X in this case.

Alternatively, the friction block 10 may be pressed against the rod 8 by means of a spring or the like. It is also conceivable that the friction block 10 is made of a resilient material, for example a rubber block, and mounted in compressed condition against the rod 8. Furthermore, the pile driving system 1 may have more than one friction block 10, for example at an opposite side of the rod 8 with respect to the location where the friction block 10 is shown in FIG. 1.

When the pile driving system as shown in FIG. 1 is used to drive a monopile (not shown) into the seabed the transition cylinder 7 and the pile driver 6 rest on the monopile, whereas the lifting element 2 including the rod 8 suspend from the hoisting cable 3, as illustrated in FIG. 1. If the tip of the monopile reaches a ground layer providing low resistance the monopile may start running into the ground due to its own weight and the weight of the pile driver 6 resting on the monopile; a blow of the pile driver 6 may trigger this condition. The pile driving system 1 will turn in a freefalling condition. Subsequently, the hoisting cable 3 will arrest the system 1. Initially, the transition cylinder 7 can almost freely move downwardly with respect to the lifting element 2 including the rod 8 until the plate 8*a* contacts a cover on top of the transition cylinder 7, since friction between the rod 8 and the transition cylinder 7 is much lower than friction between the rod 8 and the lifting element 2 due to the presence of the brake. Subsequently, inertia of the pile driver 6 causes a downward force of the rod 8 onto the friction block 10. Depending on the friction behaviour between the rod 3 and the friction block 10 the rod 8 including the pile driver 6 and the transition cylinder 7 may start moving downwardly with respect to the lifting element 2 under such conditions.

The hydraulic pressure chamber 11 always presses the friction block 10 against the rod 8, i.e. in case the pile driver 6 and the rod 8 have fixed positions with respect to the lifting element 2 as well as in case the pile driver 6 and the rod 8 move with respect to the lifting element 2. In the latter case dynamic friction occurs between the friction block 10 and the rod 8, whereas in the former case static friction occurs between the friction block 10 and the rod 8. The pile driving system 1 may be adapted such that a downward force of the rod 8 onto the friction block 10 must be more than 1.4 times the weight of the pile driver 6 in order to overcome static friction and to start moving the pile driver 6 with respect to the lifting element 2. Dynamic friction will increase quickly during moving due to heat generation causing thermal expansion of the sliding members. In order to create a progressive braking behaviour during movement the rod 8 may be slightly tapered such that the pressing force of the friction block 10 will increase during movement of the pile driver 6 and the rod 8 with respect to the lifting element 2, caused by compressing the volume of the hydraulic pressure chamber 11. Alternatively, additional hydraulic pressure may be generated during movement of the pile driver 6 and the rod 3 with respect to the lifting element 2.

Figure 2:
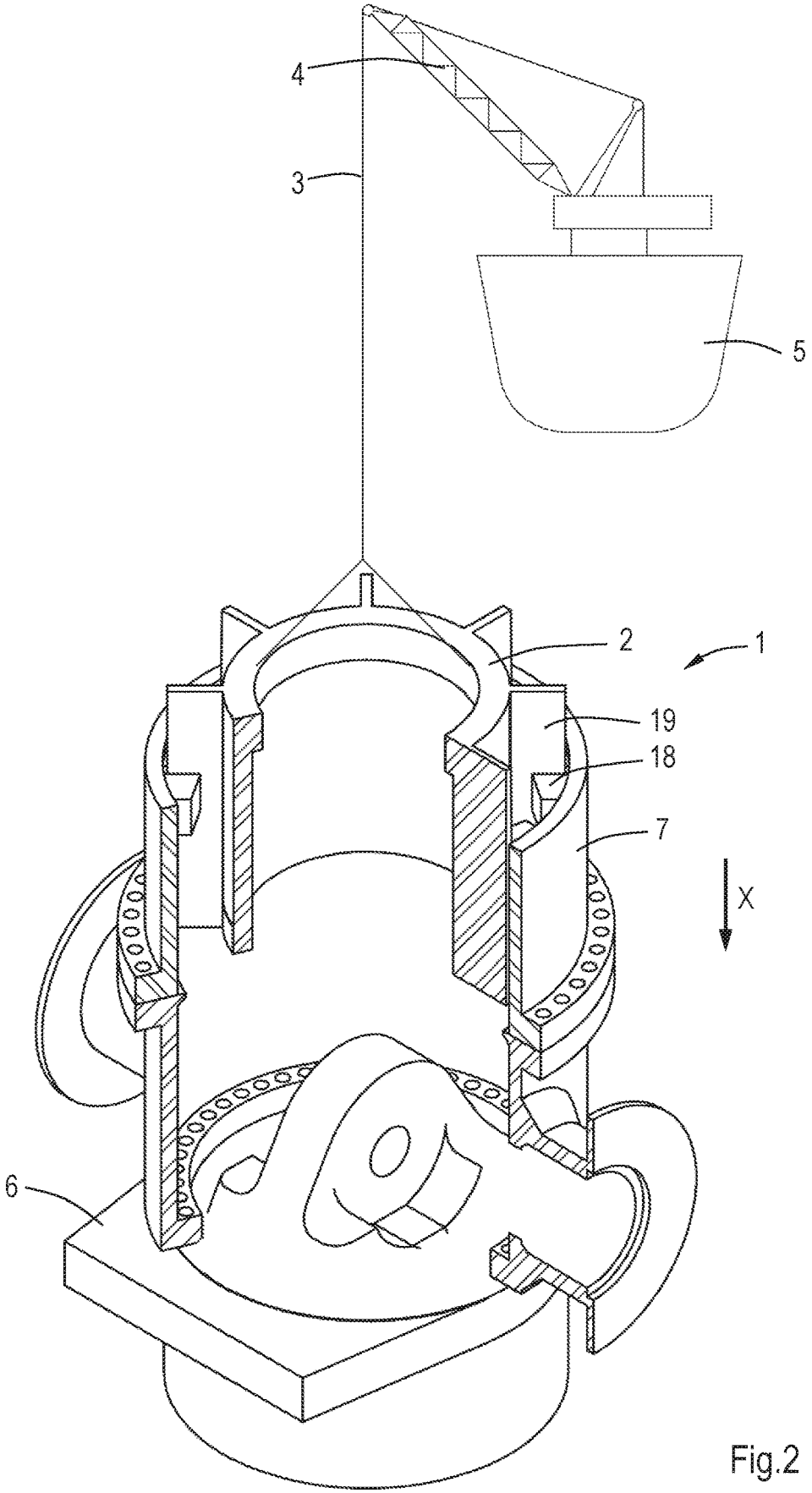
FIG. 2 is a similar view as FIG. 1, but showing an alternative embodiment.

FIG. 2 shows an alternative embodiment of the pile driving system 1. In this embodiment the transition cylinder 7 is fixed to the pile driver 6, similar to the embodiment as described hereinbefore, but it has a different shape. The lifting element 2 is movable within the transition cylinder 7 in the pile driving direction X. In this embodiment the inner side of the transition cylinder 7 is provided with pairs of friction blocks 18 which engage cooperating radial ribs 19, which project from the outer side of the lifting element 2. The ribs 19 extend in the pile driving direction X and are distributed at equiangular distance at the circumference of the lifting element 2. The pairs of friction blocks 18 exert clamping forces on the ribs 19 in order to provide a static friction under normal pile driving conditions and a dynamic friction when the pile driver 6 moves with respect to the lifting element 2 in the event that the system 1 is decelerated from a freefalling condition.

Figure 3:
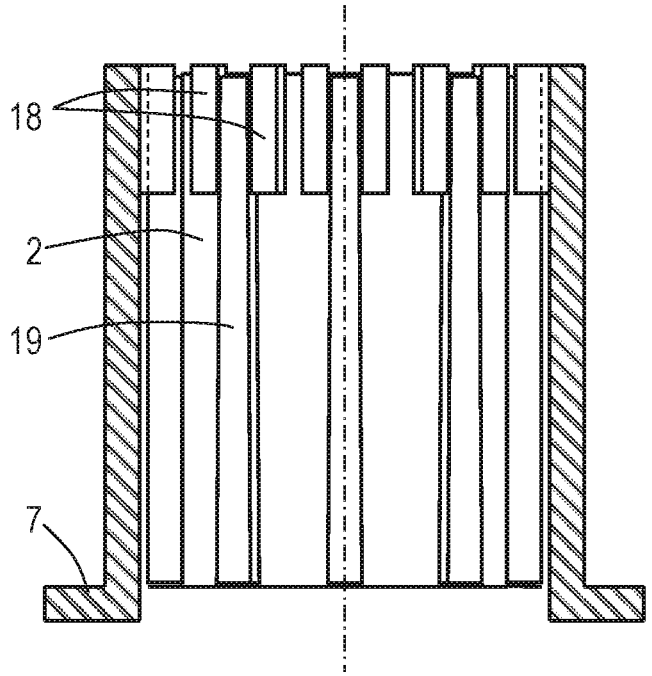
FIG. 3 is a cut-away side view of a part of the pile driving system as shown in FIG. 2.
Figure 4:
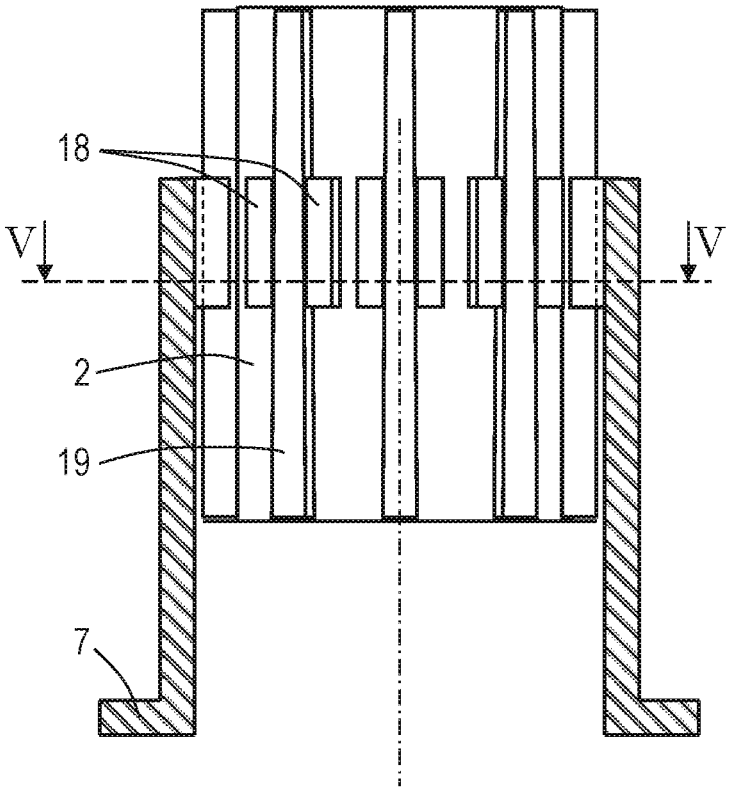
FIG. 4 is a similar view as FIG. 3, but showing the pile driving system in a different condition.

FIGS. 3 and 4 illustrate a movement of the pile driver 6 with respect to the lifting element 2. FIG. 3 shows a situation under normal pile driving conditions in which the pile driver 6 has a fixed position with respect to the lifting element 2, whereas FIG. 4 shows a condition in which the pile driver 6 including the transition cylinder 7 are decelerated through the friction blocks 18 and the cooperating ribs 19. The transition cylinder 7 may be provided with additional friction blocks at a different height in the transition cylinder 7 in order to create a stable guidance of the ribs 19 during their movement along the friction blocks 18.

Figure 5:
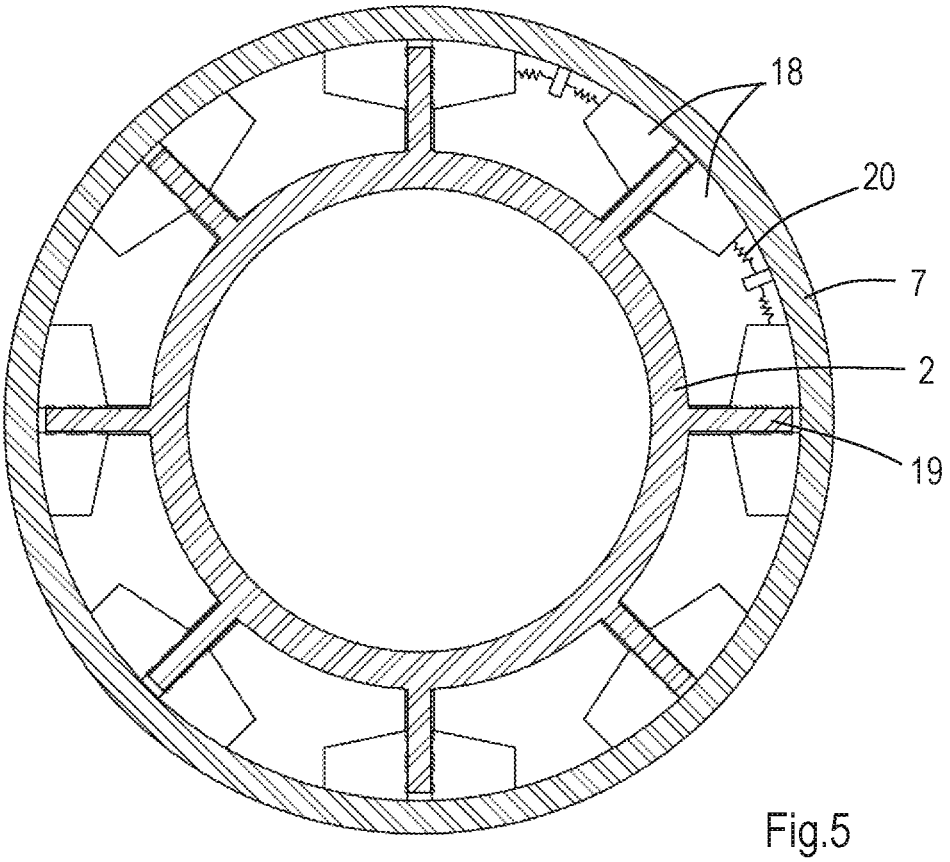
FIG. 5 is a sectional view along the line V-V in FIG. 4.
Figure 6:
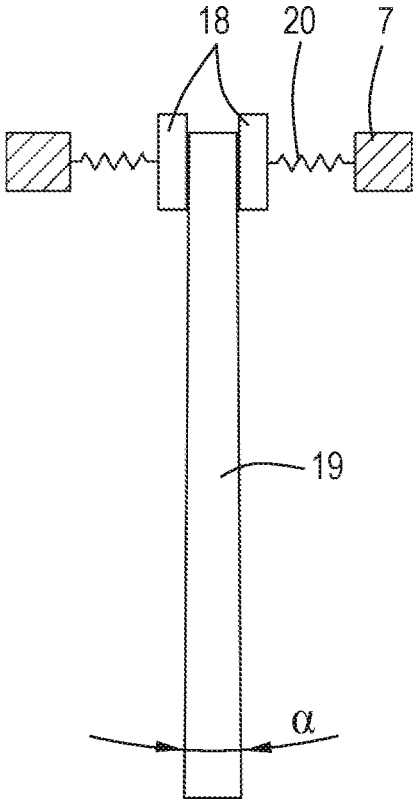
FIG. 6 is an enlarged view of a part of FIG. 3.

FIGS. 5 and 6 show in more detail the relative positions of the friction blocks 18 and the ribs 19, FIG. 6 shows that the ribs 19 are slightly tapered by a small angle α in order to provide a progressive braking force when the pile driver 6 moves downwardly with respect to the lifting element 2. FIGS. 5 and 6 also show springs 20 which are fixed to the transition cylinder 7 and press the friction blocks 18 against the ribs 19.

FIG. 2 does not show a mechanism to freely move the lifting element 2 with respect to the pile driver 6 under normal pile driving conditions, i.e. when the ribs 19 stay the same position with respect to the friction blocks 18, comparable to the plate 8*a* which s movable within the transition cylinder 7 in the embodiment as shown in FIG. 1. Such a mechanism may also be present in the embodiment of FIG. 2.

Figure 7:
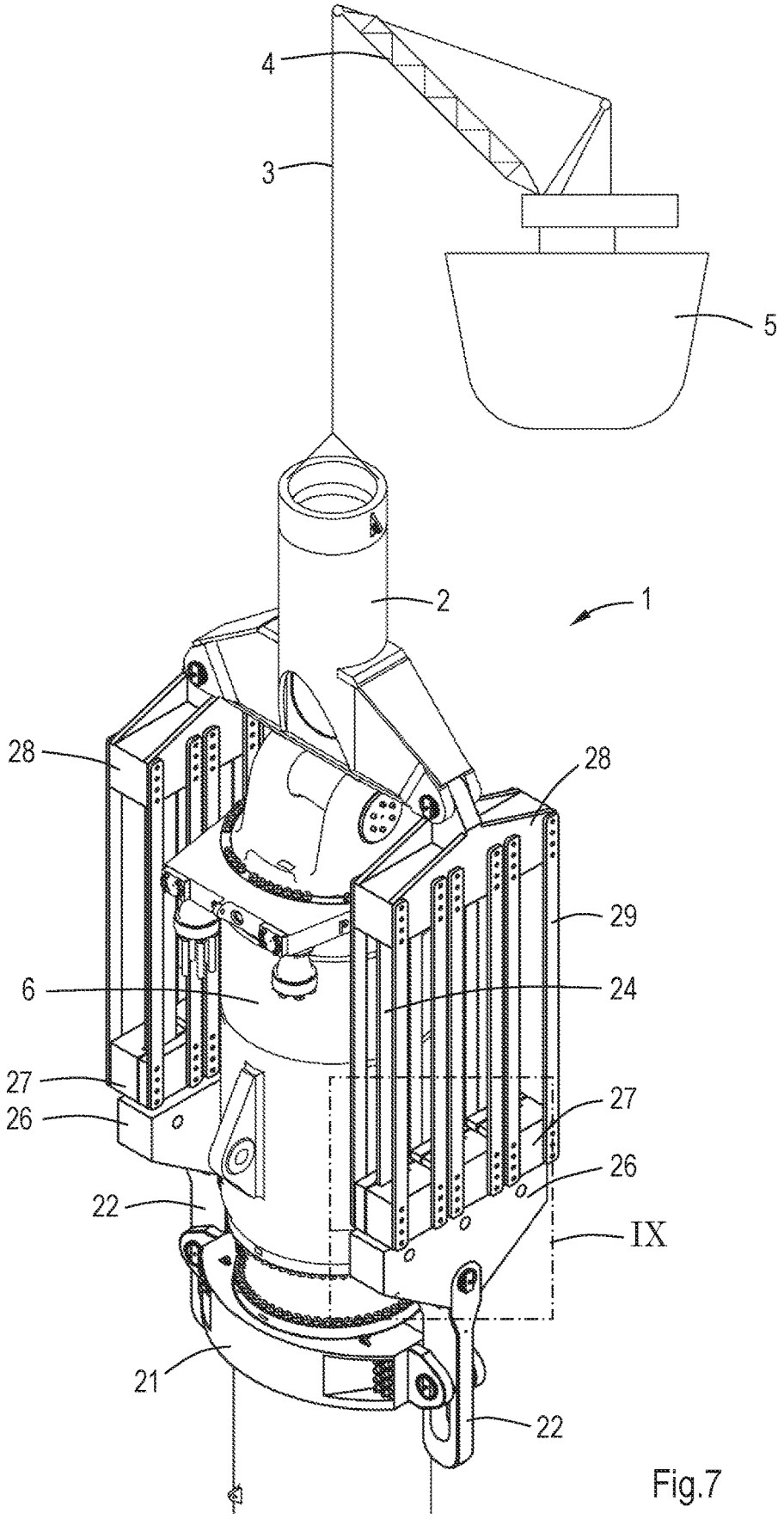
FIG. 7 is a similar view as FIG. 1, but showing an alternative embodiment of a pile driving system.
Figure 8:
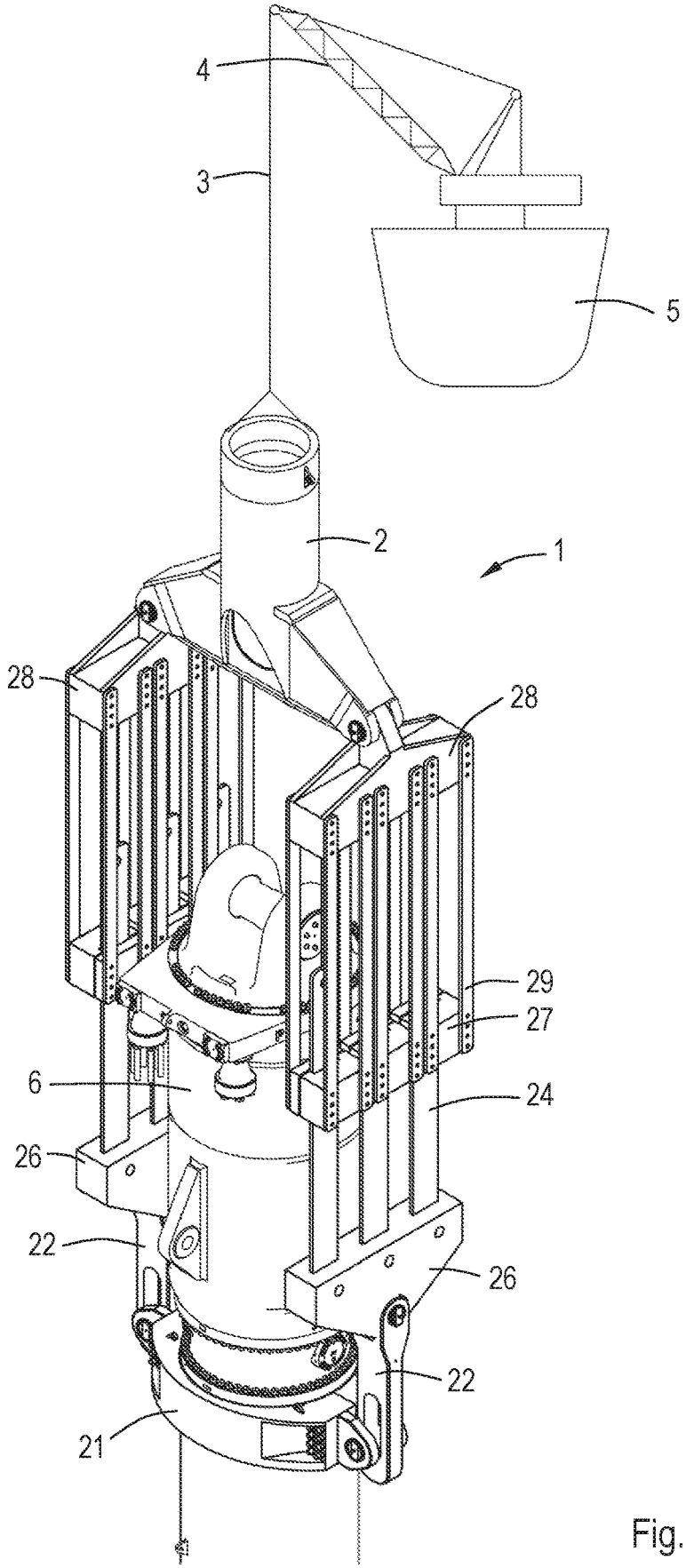
FIG. 8 is a similar view as FIG. 7, but showing the pile driving system in a different condition.
Figure 9:
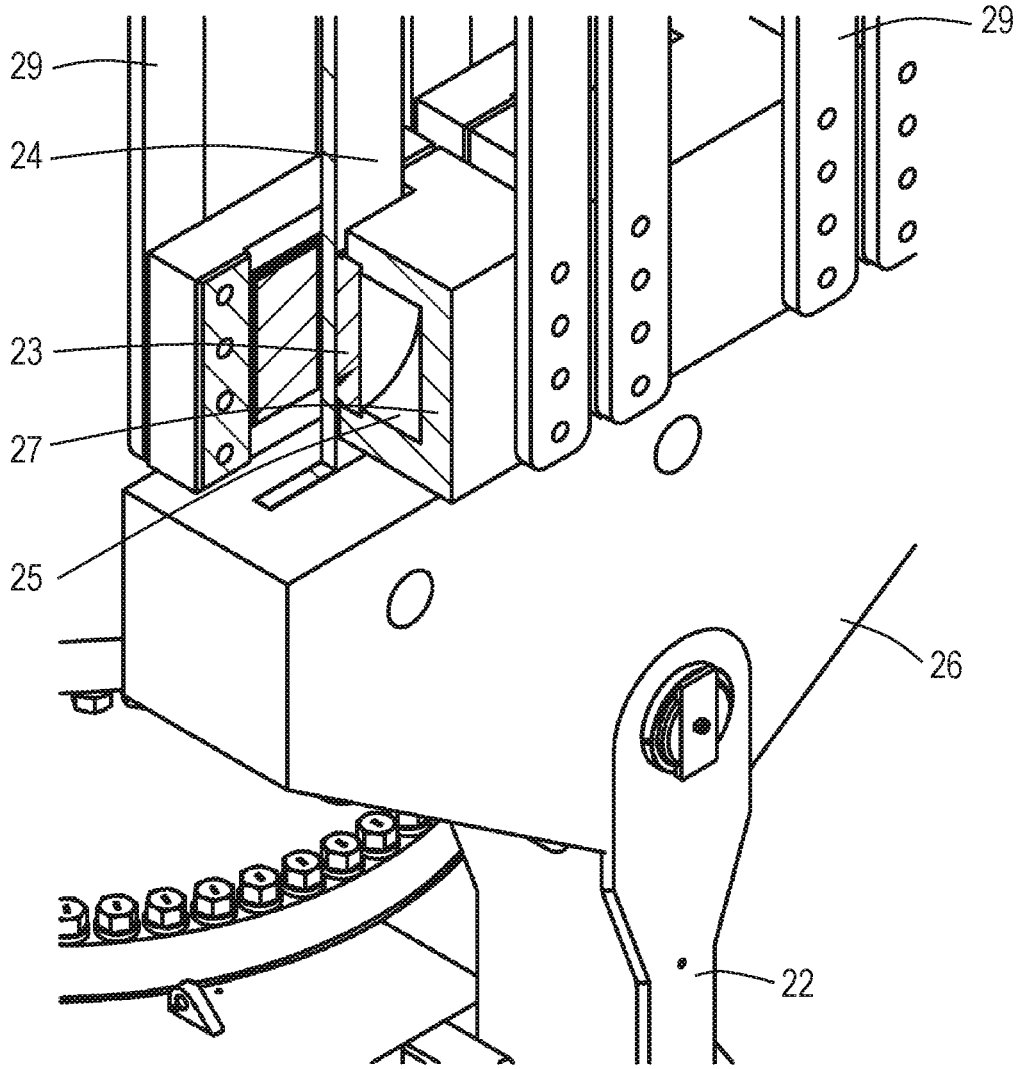
FIG. 9 is an enlarged view of a part of FIG. 7 as indicated by IX in FIG. 7.

FIGS. 7-9 show another alternative embodiment of the pile driving system 1. Similar to the embodiments as described hereinbefore, in this embodiment the lifting element 2 is attached to the hoisting cable 3 of the crane 4 on the barge 5. In this case the hydraulic pile driver 6 is coupled to the lifting element 2 through a hammer clamp 21 which is fixed to the pile driver 6 and a pair of sliders 22 which are slidably mounted to the hammer clamp 21 and located at opposite sides of the pile driver 6.

The sliders 22 have the same function as the plate 8*a* inside the transition cylinder 7 in the embodiment as shown in FIG. 1. During normal pile driving the lifting element 2 can suspend from the hoisting cable 3 and rest on the pile driver 6 between two successive blows, as shown in FIG. 7, whereas during a blow of the pile driver 6 the pile driver 6 can move downwardly with respect to the lifting element 2 through the sliders 22, after which the lifting element 2 including the hoisting cable 3 may follow the movement.

The pile driving system 1 is provided with a brake between the lifting element 2 and the respective sliders 22, which brake is in the form of friction blocks 23, see FIG. 9. The friction blocks 23 are pressed against rods 24 bar means of respective hydraulic pressure chambers 25. The pile driving system 1 as shown in FIG. 7 has two series of three rods 24, one series located at one side of the pile driver 6 and the other series located at the opposite side thereof. Both series of three rods 24 are fixed to lower yokes 26 which are in turn rotatably mounted to the respective sliders 22. The series of cooperating friction blocks 23 and the corresponding hydraulic pressure chambers 25 are accommodated it respective housings 27 which are in turn fixed to upper yokes 28 via bars 29. The upper yokes 28 are rotatably mounted to the lifting element 2.

When the pile driving system as shown in FIG. 7 is used to drive a monopile (not shown) into the seabed the lifting element 2 suspends from the hoisting cable 3 and rests on the pile driver 6 via the brake and the sliders 22. When the pile driving system 1 turns in a freefalling condition and the hoisting cable 3 arrests the system 1, the pile driver 6 may initially move downwardly with respect to the lifting element 2 and the brake through the sliders 22 only, since friction between the six rods 24 and the respective friction blocks 23 is much higher than friction between the sliders 22 and the hammer clamp 21. Subsequently, the rods 24 including the sliders 22 and the pile driver 6 can move downwardly with respect to the lifting element 2 when the inertia of the pile driver 6 causes a downward force of the rods 24 onto the friction blocks 23 which exceeds maximum static friction force between the rods 24 and the friction blocks 23. During this movement the pile driver 6 will be decelerated and eventually stop. The resulting condition after the movement is illustrated in FIG. 8.

From the foregoing it becomes clear that different types of brakes are conceivable, but each type serves to allow a movement of the pile driver 6 with respect to the lifting element 2 after arresting the lifting element 2, on the one hand, and to decelerate the resulting movement in a controlled manner, on the other hand. In fact, peak acceleration creating a shock load on the crane 4 after the pile driver 6 is freefalling is reduced by extending the duration of the impact.

The invention is not limited to the embodiments shown in the drawings and described hereinbefore, which may be varied in different manners within the scope of the claims and their technical equivalents.

The invention claimed is:

1. A pile driving system, comprising a lifting element attached or attachable to a hoisting cable of a crane, a pile driver which is mounted to the lifting element and movable with respect to the lifting element in a pile driving direction and a brake configured to brake movement of the pile driver with respect to the lifting element, the brake comprising cooperating sliding members at the lifting element and the pile driver, which sliding members are pressed against each other in a direction extending transversely to their mutual sliding direction, and wherein the sliding members are configured such that a force between the sliding members is selected such that the brake keeps the pile driver at a fixed position with respect to the lifting element by static friction between the sliding members up to a predetermined force level of the pile driver on the lifting element in their mutual sliding direction.

2. The pile driving system according to claim 1, wherein the predetermined force level is at least 1.1 times a weight of the pile driver.

3. The pile driving system according to claim 2, wherein the predetermined force level is at least 1.4 times the weight of the pile driver.

4. The pile driving system according to claim 1, wherein at least one of the sliding members is made of a resilient material.

5. The pile driving system according to claim 1, wherein one of the pile driver and the lifting element is provided with a rod extending in the pile driving direction and guided by the other one of the pile driver and the lifting element, wherein said rod forms a first sliding member of the sliding members at said one of the pile driver and the lifting element which cooperates with a second sliding member of the sliding members at said other one of the pile driver and the lifting element.

6. The pile driving system according to claim 5, wherein the first sliding member at said other one of the pile driver and the lifting element comprises a pair of friction blocks which engage the rod at opposite sides thereof.

7. The pile driving system according to claim 6, wherein the rod is tapered such that a distance between the friction blocks increases during a movement of the pile driver away from the lifting element.

8. The pile driving system according to claim 1, wherein the lifting element comprises a cylindrical outer surface which is at least partly accommodated within a cylindrical inner surface of the pile driver, wherein one of said inner surface and said outer surface is provided with at least a protruding rib extending in the pile driving direction and the other one of said inner surface and said outer surface is provided with a pair of friction blocks which exert a clamping force on the rib.

9. The pile driving system according to claim 8, wherein the rib is tapered such that a distance between the friction blocks increases during a movement of the pile driver away from the lifting element.

10. The pile driving system according to claim 9, wherein the mutual sliding direction of the sliding members and the pile driving direction are the same.

11. The pile driving system according to claim 1, wherein the mutual sliding direction of the sliding members and the pile driving direction are the same.

12. A pile driving system, comprising a lifting element attached or attachable to a hoisting cable of a crane, a pile driver which is mounted to the lifting element and movable with respect to the lifting element in a pile driving direction and a brake configured to brake movement of the pile driver with respect to the lifting element, the brake comprising cooperating sliding members at the lifting element and the pile driver, which sliding members are pressed against each other in a direction extending transversely to their mutual sliding direction, wherein at least one of the sliding members is pressed against the other by a hydraulic cylinder.

13. The pile driving system according to claim 12, wherein one of the pile driver and the lifting element is provided with a rod extending in the pile driving direction and guided by the other one of the pile driver and the lifting element, wherein said rod forms a first sliding member of the sliding members at said one of the pile driver and the lifting element which cooperates with a second sliding member of the sliding members at said other one of the pile driver and the lifting element.

14. The pile driving system according to claim 13, wherein the first sliding member at said other one of the pile driver and the lifting element comprises a pair of friction blocks which engage the rod at opposite sides thereof.

15. The pile driving system according to claim 14, wherein the rod is tapered such that a distance between the friction blocks increases during a movement of the pile driver away from the lifting element.

16. The pile driving system according to claim 13, wherein the first sliding member at said other one of the pile driver and the lifting element comprises a pair of friction blocks which engage the rod at opposite sides thereof.

17. The pile driving system according to claim 16, wherein the rod is tapered such that a distance between the friction blocks increases during a movement of the pile driver away from the lifting element.

18. The pile driving system according to claim 12, wherein the lifting element comprises a cylindrical outer surface which is at least partly accommodated within a cylindrical inner surface of the pile driver, wherein one of said inner surface and said outer surface is provided with at least a protruding rib extending in the pile driving direction and the other one of said inner surface and said outer surface is provided with a pair of friction blocks which exert a clamping force on the rib.

19. The pile driving system according to claim 18, wherein the rib is tapered such that a distance between the friction blocks increases during a movement of the pile driver away from the lifting element.

20. The pile driving system according to claim 19, wherein the mutual sliding direction of the sliding members and the pile driving direction are the same.

21. A pile driving system, comprising a lifting element attached or attachable to a hoisting cable of a crane, a pile driver which is mounted to the lifting element and movable with respect to the lifting element in a pile driving direction and a brake configured to brake movement of the pile driver with respect to the lifting element, the brake comprising cooperating sliding members at the lifting element and the pile driver, which sliding members are pressed against each other in a direction extending transversely to their mutual sliding direction, wherein at least one of the sliding members is pressed against the other by a spring.

22. The pile driving system according to claim 21, wherein one of the pile driver and the lifting element is provided with a rod extending in the pile driving direction and guided by the other one of the pile driver and the lifting element, wherein said rod forms a first sliding member of the sliding members at said one of the pile driver and the lifting element which cooperates with a second sliding member of the sliding members at said other one of the pile driver and the lifting element.

23. The pile driving system according to claim 21, wherein the lifting element comprises a cylindrical outer surface which is at least partly accommodated within a cylindrical inner surface of the pile driver, wherein one of said inner surface and said outer surface is provided with at least a protruding rib extending in the pile driving direction and the other one of said inner surface and said outer surface is provided with a pair of friction blocks which exert a clamping force on the rib.

24. The pile driving system according to claim 23, wherein the rib is tapered such that a distance between the friction blocks increases during a movement of the pile driver away from the lifting element.

25. The pile driving system according to claim 24, wherein the mutual sliding direction of the sliding members and the pile driving direction are the same.

* * * * *